United States Patent [19]

Dardick

[11] Patent Number: 4,836,082

[45] Date of Patent: Jun. 6, 1989

[54] CLOUD GUN

[76] Inventor: David Dardick, 211 E. 70th St., New York, N.Y. 10021

[21] Appl. No.: 82,191

[22] Filed: Aug. 6, 1987

[51] Int. Cl.[4] ..... F41D 10/30

[52] U.S. Cl. ..... 89/1.41; 89/12; 89/160; 89/33.03

[58] Field of Search ..... 89/1.41, 12, 33.02, 89/33.03, 160

[56] References Cited

U.S. PATENT DOCUMENTS

| | | | |
|---|---|---|---|
| 560,842 | 5/1896 | Cook | 89/1.41 |
| 563,701 | 7/1896 | Wilder | 89/1.41 |
| 1,328,230 | 1/1920 | Johnston | 89/12 |
| 1,334,983 | 3/1920 | Arter | 89/1.41 |
| 1,551,809 | 9/1925 | Dodge, Jr. | 89/1.41 |
| 3,434,380 | 3/1969 | Dardick | 89/13.05 |
| 3,446,115 | 5/1969 | Fedowitz | 89/33.03 |
| 3,492,913 | 2/1970 | Barnard | 89/33.03 |
| 3,529,509 | 9/1970 | Vuceta | 89/33.03 |
| 3,897,714 | 8/1975 | Perrin et al. | 89/12 |

FOREIGN PATENT DOCUMENTS

| | | | |
|---|---|---|---|
| 91290 | 11/1870 | France | 89/12 |
| 126398 | 5/1919 | United Kingdom | 89/33.02 |

*Primary Examiner*—Deborah L. Kyle
*Assistant Examiner*—Stephen Johnson

[57] ABSTRACT

A multiple barrel gun for firing projectiles at an extremely high rate of fire, in the form of a dense cloud of projectiles. In one embodiment, hundreds of gun barrels are rapidly rotated about a fewer number of fixed firing stations. As each group of barrels approach the fixed stations, cartridges are radially fed to the barrels, and the group of barrels are concurrently fired when they become aligned with the stations. During each complete revolution of the multiple barrel gun, all of the gun barrels are successively fired in groups a number of times corresponding to the number of firing stations. The total fire power of the gun for each revolution is accordingly equal to the number of barrels times the number of firing stations. To further increase the fire power, a second series of hundreds of gun barrels are counterrotated in opposition to the first series and are independently fed with cartridges and successively fired in groups in the same manner as the first series of barrels to double the firing rate of the gun. The elevation of the gun barrels can be individually adjusted, or automatically varied, to change the shape or diameter of the cloud of projectiles being fired. The extremely high rate of fire of the gun is permitted by the construction of the gun and the triangular shape of the cartridges that enable the cartridges to be fed and ejected from the gun barrels in a transverse direction without any reciprocatory movement.

18 Claims, 4 Drawing Sheets

FIG. 1
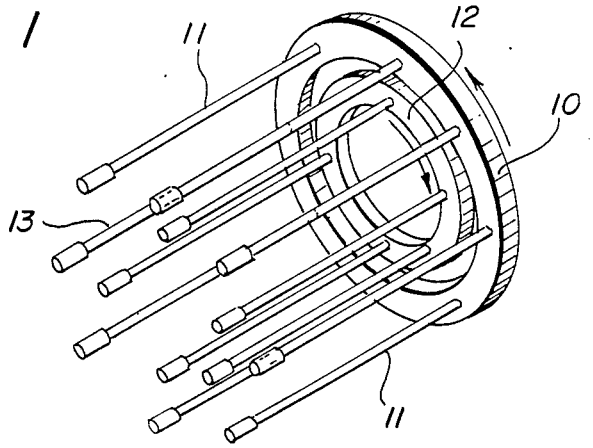
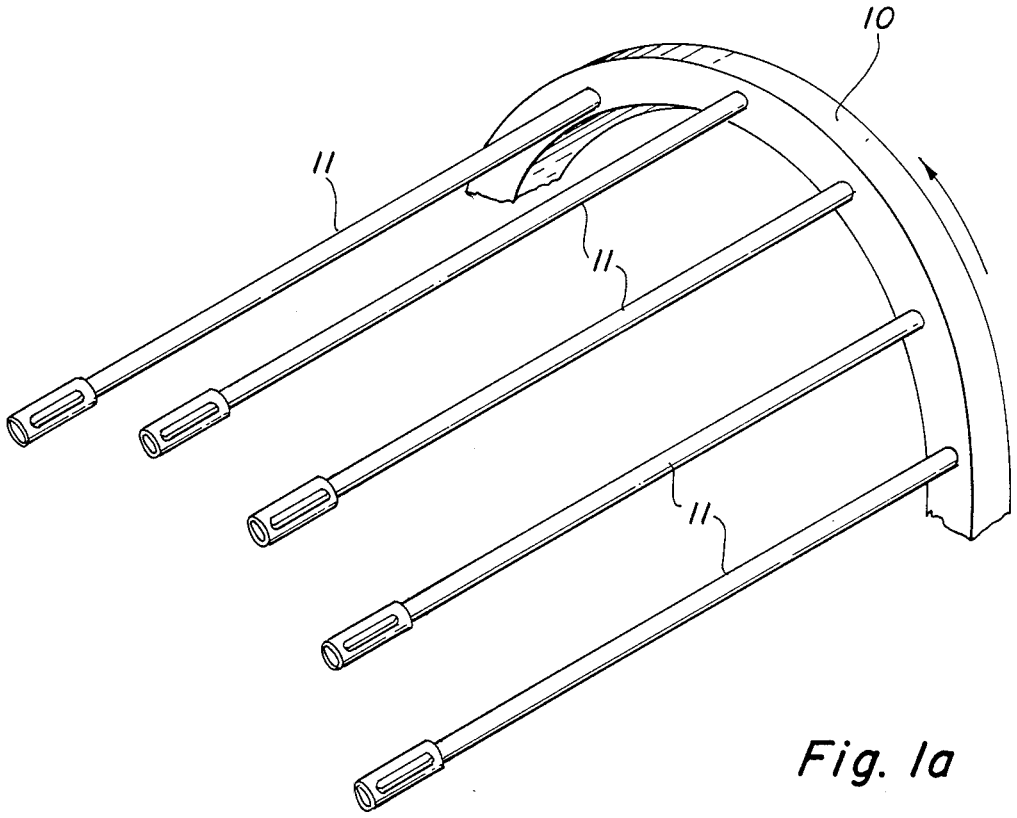
Fig. 1a

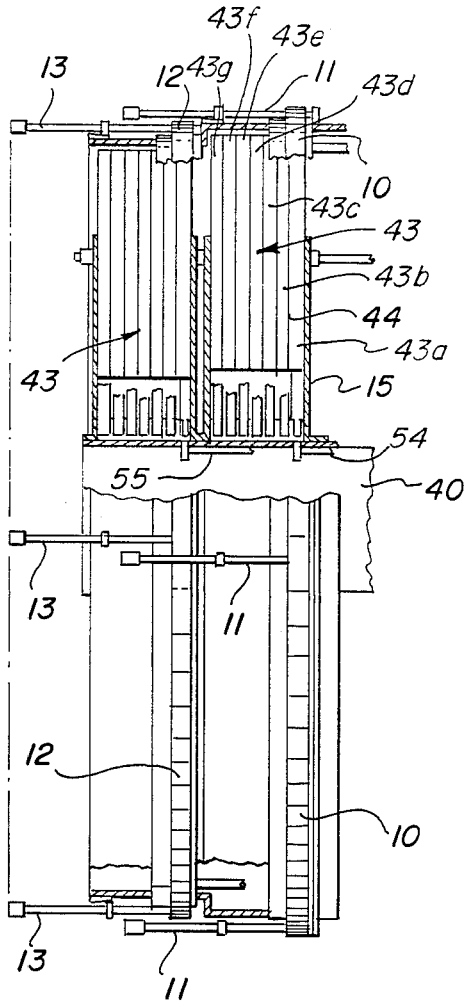
FIG. 5
FIG. 6
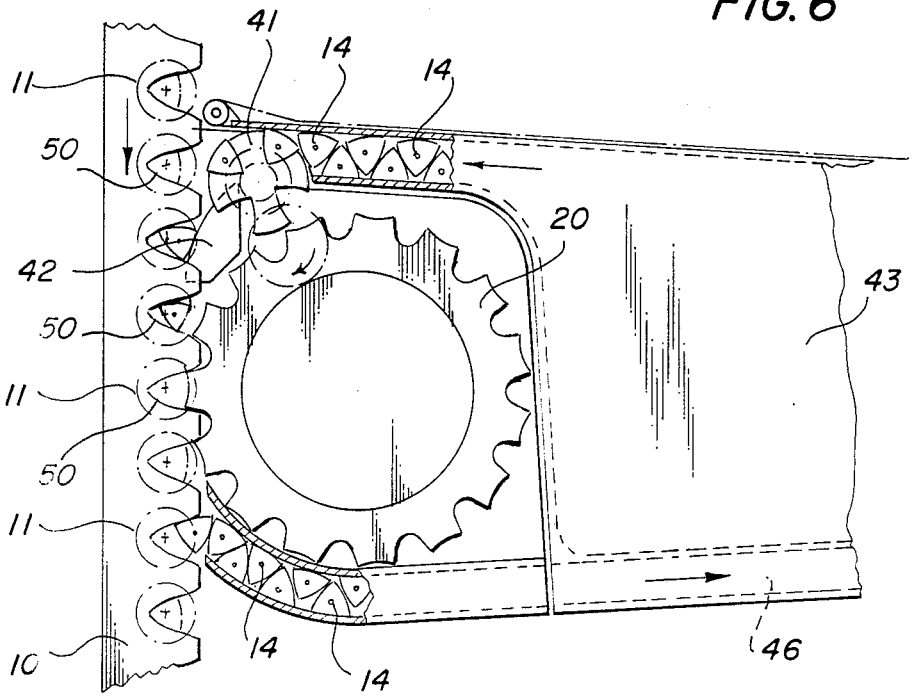

CLOUD GUN

FIELD OF THE INVENTION

This invention generally relates to extremely high rate-of-fire guns and canons, and more particularly to multiple barrel guns having large numbers of rotating barrels, and with and with groups of said barrels being fired concurrently during each incremental angle of rotation.

BACKGROUND OF THE INVENTION

For various military applications including high speed targets such as rocket propelled missiles, high rate of fire weapons are used to project a cloud of projectiles over large spatial areas to intercept and destroy any missiles passing through the blanket or cloud of projectiles. Such guns are controlled by radar to respond very rapidly, being both positioned and fired to coincide with the direction and location of the traveling missile.

In the past multiple barrel guns have been used for this purpose that are capable of firing thousands of projectiles per minute. Such guns have used multiple barrels, either fixed or rotating, that are rapidly fired in sequence to blanket an area occupied by a target so as to increase the hit probability. However, such weapons using conventional ammunition and reciprocating firing mechanisms are inherantly limited in the maximum rate of fire.

In many earlier patents of the present inventor, David Dardick, there is provided a different type of construction for both the firing mechanism of the gun and of the ammunition that permits a much higher rate of fire than before. Such weapons permit the cartridges to be fed and ejected from the gun in a transverse direction without any longitudinal movement of the cartridges. The cartridges themselves are also differently constructed in triangular cross section, rather than round, so that they are always self-aligning in the firing chamber during high speed feeding, and the spent casings are more easily ejected from the chamber at higher speeds than before.

Earlier patents of David Dardick showing constructions of this type include the following: U.S. Pat. Nos. 3,855,931, 3,601,061, 3,572,248, 3,503,300, 3,501,998, 3,486,827, 3,467,276, 3,446,113, 3,446,111, 3,434,380, 3,041,939, 2,847,784, and 2,831,401.

SUMMARY OF THE INVENTION

According to the present invention there is provided an extremely high rate-of-fire multiple barrel gun that is capable of firing projectiles at a rate of up to 50,000 projectiles each second or 1,000,000 per minute. This gun includes multiple arrays of rotating barrels, numbering in the hundreds, that rotate about groups of fixed firing stations. During each rotation of each array, all of the barrels are repetitively fired, as each barrel reaches each firing station. The entire arrays of barrels, as units, are positionable in azimuth and elevation, to cover different spatial areas, and the individual barrels are adjustable to define the diameter of the "cloud" of projectiles being fired into space. The different arrays are counter-rotated to balance the forces, and the individual barrels are correctable to minimize recoil forces. At each of the fixed group of spaced apart firing stations, the cartridges are positively fed at high speed from multiple capacity magazines, that enables the gun to fire multiple bursts, thereby to provide multiple "clouds" of large numbers of projectiles into space without the need for reloading after each "cloud" is fired.

BRIEF DESCRIPTION OF THE DRAWINGS

FIG. 1 is a perspective view, schematically illustrating two concentric arrays of rotating gun barrels according to the invention, FIG. 1A is a view similar to FIG. 1, on an enlarged scale, of portions of one array of gun barrels, FIG. 5 is a side elevational view of the overall gun assembly, with portions shown in section, FIG. 6 is an enlarged cross section, showing a portion of the ammunition feed magazine at each firing station.

DETAILED DESCRIPTION OF PREFERRED EMBODIMENTS

Figure 2:
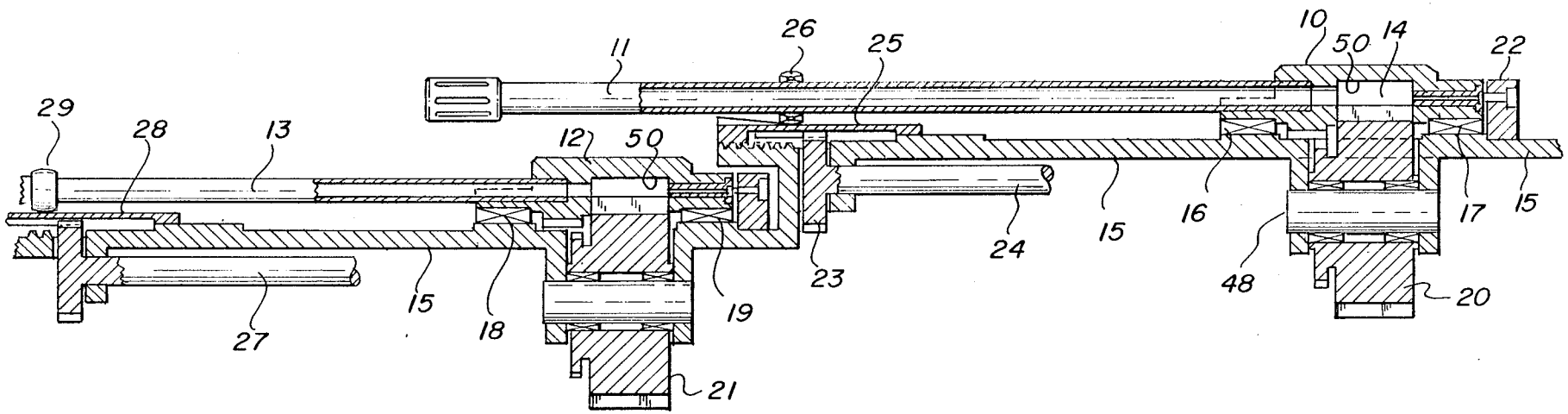
FIG. 2 is a longitudinal section, showing details of one gun from each of the two arrays.

Referring to FIGS. 1 and 1A, a preferred embodiment of the gun includes a large diameter rotatable frame member 10 carrying an array of spaced apart gun barrels 11 about its periphery. A second large diameter rotatable frame member 12 is concentrically mounted with respect to the first frame 10 and counter-rotates a second large array of gun barrels 13. The two arrays are counter-rotated to balance the large forces and torques imposed upon the stationary frame structure of the gun (not shown in FIGS. 1 and 1A). In one preferred embodiment of the gun, each of the cylindrical frame members 10 and 12 has a diameter of over seven (7) feet and supports 360 spaced apart gun barrels 11 and 13, respectively. In this embodiment, the total weight of the completed gun system, including the 720 gun barrels and other gun structure, and including the ammunition, is about 3000 pounds. It occupies an enclosure space of about 8 feet in diameter and about 4½ feet in length.

Figure 7:
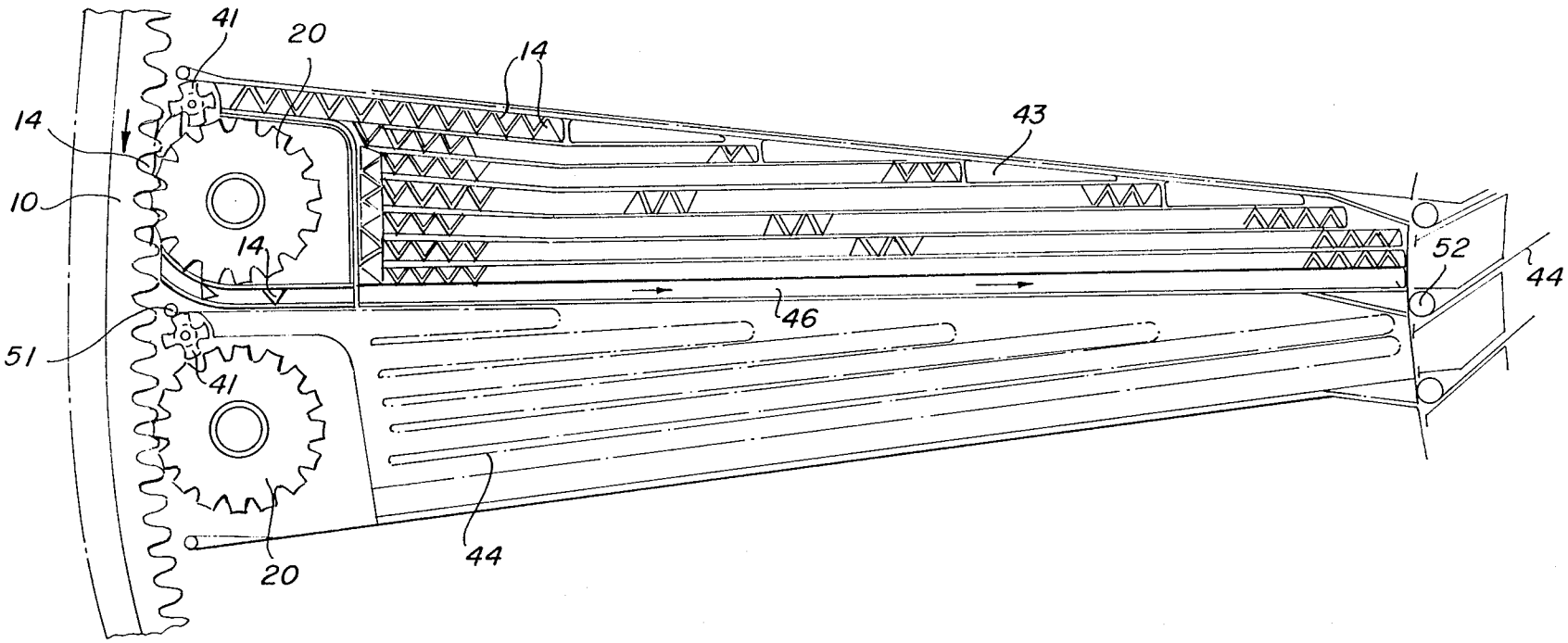
FIG. 7 is a cross sectional view, similar to FIG. 6, but showing further details of a pair of ammunition magazines at two adjacent firing stations.

For feeding cartridges of ammunition to each of the counter-rotating arrays of gun barrels 11 and 13, there is provided fifty equally space apart firing stations, and at each station is provided a multiple tier ammunition magazine, such as magazine 43 and 44 in FIG. 7. THE FIFTY firing stations are concentrically located inside of the large diameter cylindrical frame members 10 and 11, and feed the ammunition cartridges 31 to the rotating arrays of gun barrels 11 and 13 in syncronism with the rotation of the barrels. Thus to feed ammunition to the gun there is provided a total of 100 ammuition magazines, each being fixed in position in a different radial position inside of the rotating cylindrical frames 10 and 11. Returning to FIG. 7, as each gun barrel is rotated to approach each firing station, a cartridge is fed to the firing chamber for that barrel. Continued rotation of that barrel carries the cartridge to the firing station where that barrel is fired. Since there are fifty magazines concurrently feeding fifty different ones of the 360 barrels in each array, a total of fifty gun barrels are fired together as a group for each incremental angular position of the cylindrical frame members 10 and 12. The continued rotation of each of the frame members 10 and 12 brings each one of the gun barrels in each array sequentially toe ach of the other firing stations, whereby each gun barrel is fired a total of fifty times during each complete rotation of its cylindrical support member 10 or 12. Since there are a total of 720 gun barrels, in the two arrays, and each is fired fifty times during each rotation of its cylindrical support member 10 or 12, the total fire power for each complete revolution is 36, 000 firings.

In this preferred embodiment, the two counter-rotating cylindrical support members 10 and 12 are driven in syncronism by electric motors (not shown) to rotate at a speed of 83⅓ revolutions per minute or 1 2/5 revolutions each second. Since each gun barrel is fired fifty times during each revolution, each gun barrel is fired a total of 70 times during each one second burst (1 2/5 times 50). During each one second burst, the total firepower of all 720 barrels is about 50,000 firings (720 barrels times 70 firings each second for each barrel). Firing tests have shown that a firing rate of 70 firings per barrel per second is well within the present state-of-the-art with sufficient cooling down period between successive one second bursts.

Figure 4:
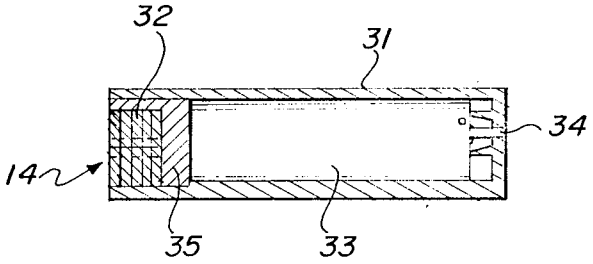
FIG. 4 is a longitudinal section of the cartridge of FIG. 3 taken along line 4—4 of FIG. 3.
Figure 3:
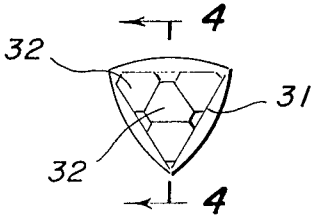
FIG. 3 is a cross sectional view of one ammunition cartridge.

According to the invention, the ammunition cartridges are triangularly shaped in cross section, a shown in FIGS. 3 and 4, to be compatible with the construction of the gun, thereby permitting the very positive high speed feeding, firing, and ejection of the cartridges as described. As will be recalled from above, a total of 50,000 cartridges are fired by the gun during each one second burst. Since the cartridges are fed to each rotating array of gun barrels from a total of fifty magazines, or a total of 100 magazines for all barrels, each magazine supplies a total of 500 cartridges for each one second burst.

Referring to FIGS. 3 and 4, each ammuniton cartridge 14 includes a triangularly shaped hollow casing 31 of suitable lightweight and strong material, such as molded polycarbonate. The interior of each casing contains a propellant material 33, such as uncolloided or cubed nitrocellulose, or more conventional gun propellant, occupying most of its rear chamber portion. At the forward end of each cartridge 14 is provided a multipiece projectile 32, that in a preferred embodiment may comprise five layers of six sided flat discs 32, as shown, each layer having four of said discs 32 within the triangularly shaped interior of the casing 31. This multiple disc projectile 32 is propelled by a plastic wad or obturator 35, after ignition of the propellant 33. After exiting from the gun barrel, the expanding gun gases separate the twenty discs of each projectile, thereby providing a uniform distribution of the discs after each firing. Sicne each one second burst from the mult-barrel gun provides 50,000 firings and each firing releases 20 discs 32, a total of 1,000,000 discs 32 are fired during each one second burst from the gun.

To enable ech magazine to fire 500 cartridges for each one second burst, each cartridge is preferably ignited by an electric spark directed through opening 34 in the rear of the casing (FIG. 4) to ignite the propellant 33. This ignition spark is generated by a piezo-electric crystal ignitor 22 that is located at the rear of the firing chamber for each gun barrel, as best shown in FIG. 2. Using electric spark ignition, and using nitrocellulose as the propellant 33, the ignition period for each cartridge 14 has been found to be less than 2 milliseconds.

In the preferred embodiment using 20 steel discs 33 for each cartridge, each weighing 0.75 grains, sufficient propellant is used to propell the projectiles at a speed of 4000 feed per second. The weight of each complete cartridge is 30 grains in one embodiment.

Briefly recapitulating the operation as described above, each of the counter-rotating arrays of gun barrels is successively fired in groups of 50 gun barrels at a time. Continuing rotation of the cylindrical frame member 10 and 12 then advances the next group of 50 gun barrels (for each array) to the 50 firing stations where the second group of 50 gun barrels are fired. Since each cartridge 14 fires 20 steel discs 32, a total of 1000 steel discs 32 are released from each array of guns for each firing operation. Since 50 barrels from each array are fired in advance of the next volley from the next group of gun barrels, thereby creating an elongated cloud of discs in space during each one second burst of repetitive firings. With muzzle velocities of 4000 feet per second, this cloud of 1,000,00 fired discs 32 in each one second burst occupies a spatial volume up to 4000 feet long, or greater, and a selectable diameter of up to 800 feet. With such large dimensions, this cloud of discs 32 can intercept and destroy targets intercepting this this vast volume of moving projectiles traveling at 4000 feet per second.

FIG. 6 illustrates an enlarged portion of one of the fifty ammunition magazines 43 feeding cartridges to each array of 360 gun barrels. As shown, each magazine stores a large number of triangularly shaped cartridges 14 that are serially fed through a channel at the upper left hand portion, as indicated by the arrow, to a rotating feed wheel 41 having four triangularly shaped cavities. The cartridges 14 are serially fed to the wheel 41 entering into successive cavities as the wheel 41 rotates past the channel. Continued rotation of the feed wheel 41 directs each cartridge 14 in sequence to the next available cavity in the rotating cylindrical frame member 10, assisted by a fixed infeed guide member 42. The guide member or finger 42 enters each of the cavities in the feed wheel 41 and effectively pries each cartridge 14 out of that cavity and into the next available cavity in the rotating frame member 10. As shown, each of the cavities in the rotating frame member 10 is in alignment with a different one of the gun barrels 11 carried by the rotating cylindrical frame 10, and it forms a portion of the firing chamber for each gun barrel 11. Continued rotation of the cylindrical frame member 10 brings that gun barrel 11 and the cartridge 14 into a fixed firing position. At this firing position, one of the truncated teeth of the rotating top strap wheel 20 enters into that cavity 50, as shown, closing the firing chamber for that gun barrel 11. At that time, an electric spark ignitor (FIG. 1) ignites the propellant 33 firing the 20 disc projectiles 32 (FIGS. 3 and 4) through the gun barrel 11. As noted above, each of the rotating frame member 10 nd 12 is provided with 50 of such ammunition magazines, that are concentrically located about the inside of each of the rotating frame members 10 and 12. Thus the above described feed and firing of the cartridges from the magazine 43 in FIG. 6 is duplicated fifty times for each of the rotating frame members 10 and 12.

Continued rotation of the cylindrical frame member 10 in FIG. 6 carries the spent cartridge casing 14 past the fixed firing position where an eject guide member (not shown) pries the casing 14 from its cavity 50 in the rotating frame 10, and guides the casing out through an eject channel 46 at the bottom of the magazine 43, as shown. The speed of rotation of both the the feed wheel 41 and the top strap wheel 20 are syncronized with the peripheral speed of the rotating cylindrical frame member 10 whereby each cartridge 14 is positively fed from the magazine 43 to the cavity 50 in the firing chamber for a gun barrel and is ejected from that cavity back to the magazine after firing.

FIG. 7 shows two adjacent ones of the ammunition magazines 43 and 44, respectively, both operating concurrently to feed and eject cartridges 14 at two firing locations for one array of the multi-barrel gun. As shown, each magazine is the same, including its own feed wheel 41 and top strap wheel 20, together within feed guides and outfeed guides, as discussed above in connection with FIG. 6. For positive advancement of the cartridges 14 to the feed wheel 41, the cartridges 14 in each magazine are carried on a continuous belt (as best shown by the lower magazine 44) that is looped back and forth within the magazine to completely fill the magazine with cartridges 14. For positive serial feed of the cartridges 14 to the feed wheel 41, a drive pulley 52 located at the rear of each magazine withdraws the belt from the magazine, sequentially feeding the cartridges 14 over the inlet channel to the feed wheel 41.

FIG. 2 shows further details of a preferred construction of the rotatable cylindrical frame member 10 and 12; the gun barrels 11 rotated by the frame members; and the firing chambers and firing mechanisms for the gun barrels. As shown, a stationary frame 15 provides the basic fixed suport for both of the counter rotating multiple gun arrays 11 and 13, respectively, that rotate about this fixed frame 15. The upper array of gun barrels 11 are carried by the cylindrical frame 10 that is rotatably mounted on the fixed frame by bearings 16 and 17. Similarly, the lower array of multiple gun barrels 13 are carried by the cylindrical frame 12 and is rotatably mounted by bearings 18 and 19. The cavity 50 for receiving the cartridge 14 is provided in the cylindrical frame 10 in alignment with the gun barrel 11. When the frame 10 and barrel 11 are in proper firing position, this cavity 50 is closed by a tooth of the rotating top strap wheel 20, as shown, to form a closed firing chamber for that cartridge 14. At each of the 50 firing stations for each array of gun barrels, there is provided a fixed piezo-electric ignitor 22 with rear access to the closed firing chamber, as shown, to ignite the propellant in the cartridge 14. It will be noted that while both arrays of counter-rotating gun barrels are concentric, the two arrays are axially displaced from each other, with the inner array carried by rotatable frame member 12 being located ahead of the outer array carried by rotatable frame 10. This provides the space for placement of the fifty ammunition magazines feeding each array to be concentrically arranged inside of the rotable cylindrical frame members 10 and 12, respectively, as best shown in FIG. 5.

Returning to FIG. 2, where it is desired to adjust the diameter of the cloud of projectiles being fired, the elevation of each of the gun barrels can be adjusted, either manually or automatically. This is performed by providing an adjustable cam member 25 on the fixed frame 15 and a cam follower 26 near the forward end of each gun barrel. The cam 25 can be adjusted to vary its incline by rotation of shaft 24 and gear 23 that axially moves the cam surface 25 forward and backward with respect to the follower 26 on the gun barrel. These cams 25 and adjusting mechanisms are provided at each firing station and can be coupled to be adjusted together, or individually, to change the elevation of each gun barrel as it reaches each firing station, thereby to adjust the degree of divergence of the cloud of projectiles being fired. A similar adjustable cam mechanism, including members 28 and 29 is provided for the second array of gun barrels 13.

As previously described, in one embodiment each one second firing burst of all 720 gun barrels fires a total of 50,000 cartridges to project 1,000,000 discs of steel projectiles in a long and large diameter cloud of projectiles. Each gun barrel is repetitively fired a total of 70 times during this one second burst interval, and each of the 100 ammunition magazines (for both arrays of gun barrels) feeds a total of 500 cartridges. Each ammunition magazine therefore contains at least 500 cartridges to be emptied during the one second firing burst.

To provide the gun with multiple burst firing capability, a preferred embodiment of the gun employes a multiple tier or multiple section magazine, with each tier having 500 cartridges, as best shown in FIG. 5 As shown, each such magazine 43 contains seven sections or tiers **43*a* to 43*g*, inclusive, that are disposed in stacked arrangement at each of the 50 firing stations. Each such section or tier is constructed as shown in FIG. 7, containing a total of 500 cartridges 14, and that section or tier functions in the same manner as previously described. After the first one second firing burst, the first tier 43*a* is emptied of cartridges, and a magazine indexing motor (not shown) rotates the fifty shafts 54 to withdraw the first tier 43*a* and advance the second tier 43*b* of the magazine 43 into firing position, best shown in FIG. 6 or FIG. 7. In a similar manner, the fifty shafts 55 are rotated by the same motor to advance the second tier of the 50 magazines feeding the second array of gun barrels 13**. By providing the magazines with these seven tiers or sections, a total of 7,000,000 steel disc projectiles may be fired in seven one second firing bursts, thereby to provide seven clouds of fired projectiles, as described.

It is to be particularly noted that the extremely high rate of of fire and the total firepower of the gun of the present invention is enable in significant part by the triangular construction of the cartridges 14 and of the gun. The cartridges are fed, fired, and ejected from the guns with transverse movement only and without any reciprocatory movement of the firing mechanism or of the cartridges. The triangular configuration of the cartridges 14 also enables the spent cartridge casings to be more readily removed from the firing chambers at higher speeds and with less liklihood of jamming.

All of the various drives and control mechanisms are performed using electric drive motors, gearing, and various switching controls (not shown). These include the electric drives to rotate the large cylindrical frame members 10 and 12 that rotate the arrays of gun barrels 12 and 13, respectively; as well as the electric drives for all of the 100 ammunition magazines, including the feed wheels 41, the top strap wheels 20, the drives for pulleys 52, and the electric drives for indexing shafts 54 and 55. As described above, all of the above parts are driven in syncronism; to feed and eject the cartridges 14 in syncronism with the rotation of the two arrays of multiple gun barrels. Accordingly a series of individual motors can be employed and electrically syncronized, or fewer motors used together with gearing and suitable mechanical couplings.

Because of the comparatively large weight and inertia of the 720 rotating gun barrels and associated moving parts, the gun is initially conditioned or armed in advance for firing, and then placed in a firing mode for the one second firing bursts. This is performed by initially accellerating the rotation of the two arrays of guns, to bring there speed up to the desired rate of 83⅓ revolutions per minute, and to stabilize their speed at this desired rate. During this arming period, the ammunition feeding magazines 43 are maintained at rest and cartridges are not fed to the guns. When it is desired to commence firing, in response to a command from a Radar fire control system (not shown), or a manual command, or other, the 720 ignition electrodes 22 are energized, and the ammunition magazine drives are actuated to feed the cartridges to the rotating guns by energizing the motors for the tape pulleys 52, the feed wheels 41, and the top strap wheels 20. Since the weight and inertia of the entire one second burst of cartridges 14 is only a small fraction of that of the rotating 720 gun barrels and associated parts, the one second burst can be fired very rapidly once the gun has been armed for firing.

It will be appreciated by those skilled in the art that many changes may be made from the preferred embodiments as described without departing from the spirit and scope of this invention. For example, the number of gun arrays, the number of gun barrels in each array, may all be varied as may the ammunition magazines and the cartridges, including the muzzle velocities, the types of propellant, the number and kind of projectiles for each cartridge, and many other variables. where multiple disc projectiles are used for each cartridge, the bores of the gun barrels are preferably triangular in cross section. However, projectiles of other types, sizes, and materials may be used, along with barrels having circular bores. Each of the many gun barrels may be supported on the rotatable cylindrical frames using resilient or "soft" mounts to cushion recoil, or muzzle brakes may be used. Since these and many other changes may be made without departing from the invention, this invention is to be considered as being limited only by the following claims:

I claim:

1. A multiple barrel gun for high rate of fire comprising:

means for rotating at high speed a first series of gun barrels in a circular path, means for oppositely rotating at that speed a second series of gun barrels in a circular path concentric with the first series but axially displaced therefrom, means for feeding cartridges to the first series of gun barrels from a lesser number of fixed firing stations equally spaced along said circular path, means for feeding cartridges to the second series of gun barrels from fixed firing station along said second path, means forming an open sided firing chamber for each of the gun barrels in both series of barrels, said firing chambers being triangular in cross section and receiving and ejecting triangularly shaped cartridges in a direction transverse to the gun barrels and free of any axial movement of the cartridges during feeding, firing, and ejection.

2. In the gun of claim 1, said means for feeding cartridges comprising a multiple tier magazine having a large number of cartridges in each tier, for rapid firing of the cartridges in each tier in a short time bust.

3. In the gun of claim 1, means for syncronizing the feed of the cartridges with the rotation of the first and second series of gun barrels.

4. In the gun of claim 1, means for adjusting the elevation of the gun barrels.

5. In the gun of claim 1, said means for feeding the triangularly shaped cartridges including a rotating feed wheel having triangularly shaped cavities to serially receive the cartridges and convey the cartridges to the firing chamber of the gun barrel in a transverse direction free of axial movement, and including a top strap wheel having projecting teeth to close the open side of the firing chamber after a cartridge has been fed to that chamber in readiness for firing.

6. In the gun of claim 1, said fixed firing stations being spaced apart from each other to concurrently feed cartridges to a number of the barrels corresponding to the number of firing stations.

7. In the gun of claim 1, means for initially accelerating the rotation of the first and second series of gun barrels without feeding of the cartridges until the speed of rotation reaches a preset level, thereby to arm the gun for firing, and thereafter initiating the feeding of cartridges when it is desired to fire.

8. In the gun of claim 1, each of the feeding means for each series of gun barrels supplying cartridges to each barrel of that series during each complete rotation of that series of barrels, thereby to repetitively fire each barrel a number of times corresponding to the number of firing stations.

9. An extremely high rate of fire gun comprising:

a rotatable support member carrying a large number of spaced apart gun barrels, in a cylindrical array, means defining a firing chamnber in said support member in alignment with each of the gun barrels, said firing chambers being of triangular cross section with one side of the triangle being open to transversely receive a triangularly shaped cartridge to be fired, a lesser number of firing stations concentrically arranged with respect to said rotatable array of gun barrels and fixed in position, each firing station including an ammunition magazine for transversely feeding cartridges to each of said rotatable gun barrels as each barrel is successively brought into position to that firing station, each of said magazines having a movable closure member to close the open side of the firing chamber after a cartridge has been fed into that firing chamber, means for syncronizing the operation of the ammunition magazines with the rotation of the support member to concurrently fire the gun barrels at all of the firing stations, a second rotatable support member, carrying a similar number of gun barrels, and concentrically rotatable with the first mentioned support member but in an opposite direction, a second series of fixed firing stations for the gun barrels on the second rotatable support member, and an ammunition magazine for each of the second series of fixed firing stations.

10. In the gun of claim 9, means for concurrently feeding the ammunition from all of the firing stations as each of the gun barrels reaches each station, whereby each of the gun barrels is repetitively fired a number of times during each revolution of the rotatable support member, corresponding to the number of firing stations.

11. In the gun of claim 9, said firing chambers being triangular in cross section and having one wall forming a side of the triangle being open to transversely receive a triangularly shaped cartridge of ammunition.

12. In the gun of claim 9, means for changing the elevation of the gun barrels.

13. In the gun of claim 9, means for changing the azimuth direction of the gun barrels.

14. In the gun of claim 9, said ammunition magazines including a feed wheel having plural cavities for sequentially conveying each cartridge in the magazine in a transverse direction to a different one of the firing chambers as each firing chamber reaches a firing station, and including a rotary top strap having a plurality of projecting teeth, each tooth entering into and closing a firing chamber after a cartridge has been inserted therein, in readiness for firing the cartridge.

15. In the gun of claim 9, said firing chambers being triangular in cross section with an open side wall to transversely receive and fire triangularly shaped cartridges at high speed without any axial movement of the cartridges.

16. In the gun of claim 9, cam means associated with each of the gun barrels at each of the firing stations for wobbling the barrels as the cylindrical support member is rotated to periodically change the direction of the fire.

17. An extremely high rate of fire gun comprising:

a rotatable support member carrying a large number of spaced-apart gun barrels, in a cylindrical array, means defining a firing chamber in said support member in alignment with each of the gun barrels, said firing chambers being of triangular cross section with one side of the triangle being open to transversely receive a triangularly shaped cartridge to be fired, a lesser number of firing stations concenrically arranged with respect to said rotatable array of gun barrels and fixed in position, each firing station including an ammunition magazine for transversely feeding cartridges to each of said rotatable gun barrels as each barrel is successively brought into position to that firing station, each of said magazines having a movable closure member to close the open side of the firing chamber after a cartridge has been fed into that firing chamber, means for syncronizing the operation of the ammunition magazines with the rotation of the support member to concurrently fire the gun barrel at all of the firing stations, each of said ammunition magazines having multiple tiers of cartridges, timing means for firing the multiple barrel gun in a burst of short duration to empty the cartridges in a tier in all magazines, said timing means thereafter advancing the next tier of cartridges in all magazines into a feed position in readiness for the firing of the next burst of fire.

18. An extremely high rate of fire gun comprising:

a rotatable support member carryng a large number of spaced apart gun barrels in a cylindrical array, means defining a firing chamber in said support member in alignment with each of the gun barrels, said firing chambers being of triangular cross section with one side of the triangle being open to transversely receive a triangularly shaped cartridge to be fired, a lesser number of firing stations concentrically arranged with respect to said rotatable array of gun barrels and fixed in position, each said firing station including an ammunition magazine for transverely feeding cartridges to each of said rotatable gun barrels as each barrel is successively brought into position to that firing station, each of said magazines having a movable closure member to close the open side of th firing chamber after a cartridge has been fed into that firing chamber, means for syncronizing the operation of the ammunition magazines with the rotation of the support member to concurrently fire the gun barrels at all of the firing stations, a second rotatable support member carrying an equally large number of spaced apart gun barrels, a second plurality of ammunition magazines for feeding cartridges to the plural gun barrels on the second support member, said rotatable support member and second rotatable support member being rotatably mounted for coaxial rotation in opposite directions, said rotatable support member and second rotatable support member being axially displaced from each other, said plurality of magazines and said second plurality of ammunition magazines being circumferentially spaced apart to feed cartridges to the multiple gun barrels carried by the first and second support members, respectively.

* * * * *